US006454610B1

(12) United States Patent
Yu

(10) Patent No.: US 6,454,610 B1
(45) Date of Patent: Sep. 24, 2002

(54) ELECTRICAL CONNECTOR ASSEMBLY HAVING FULL-INSERTION INDICATING MEANS

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/996,444

(22) Filed: Nov. 28, 2001

(51) Int. Cl.[7] ..... H01R 17/00
(52) U.S. Cl. ..... 439/660; 439/736; 439/74
(58) Field of Search ..... 439/660, 736, 439/444, 74, 912, 733.1

(56) References Cited

U.S. PATENT DOCUMENTS 5,772,474 A * 6/1998 Yagi et al. ..... 439/660
5,902,136 A * 5/1999 Lemke et al. ..... 439/74
6,010,370 A * 1/2000 Aihara et al. ..... 439/660
6,045,408 A * 4/2000 Takemasa ..... 439/660

* cited by examiner

*Primary Examiner*—Hien Vu
(74) *Attorney, Agent, or Firm*—Wei Te Chung

(57) ABSTRACT

An electrical connector assembly comprises a receptacle connector (2) having a first insulative housing (20) and a plug connector (1). The first insulative housing comprises a pair of opposed sidewalls (24) defining a cavity (25) therebetween, and windows (23) defined in the sidewalls. A plurality of first contacts (22) are disposed in the cavity and each comprises a mating portion (222), a free end (220) and a solder portion (221). The free end extends outward of the sidewall through the window when the plug connector is completely inserted into the receptacle connector for facilitating visual identification by the user.

3 Claims, 4 Drawing Sheets

ELECTRICAL CONNECTOR ASSEMBLY HAVING FULL-INSERTION INDICATING MEANS

BACKGROUND OF THE INVENTION

1. Field of the Invention

The present invention relates to a board to board connector assembly interconnected between two printed circuit boards (PCBs), and particularly to a board to board connector assembly having means for indicating full insertion of a plug connector into a receptacle connector thereof.

2. Description of Prior Art

Board to board connector assembly for connecting one PCB to another PCB is widely used in computer, notebook and other electrical products. FIG. 4 illustrates a conventional board to board connector assembly comprising a first connector 90 and a second connector 92. When the first connector 90 mates with the second connector 92, a cavity 98 of the second connector 92 receives opposed sidewalls 96 of the first connector 90. Meanwhile, contacts 94 of the first connector 90 press against contacts 95 of the second connector 92 to establish electrical connection therebetween. However, there is no indicating means provided to the connector assembly to indicate whether the first connector 90 is in a full insertion position or not. Thus, it is difficult for the user to identify the mating status of the connector assembly and the connector assembly may be damaged if the user operates incorrectly.

Hence, an improved board to board connector assembly having full-insertion indicating means is required to overcome the disadvantages of the conventional connector assembly.

SUMMARY OF THE INVENTION

Accordingly, the object of the present invention is to provide an improved board to board connector assembly having full-insertion indicating means for facilitating assembly by the user and for preventing damage to the connector assembly.

In order to achieve the above-mentioned object, a board to board connector assembly in accordance with the present invention comprises a plug connector and a receptacle connector having an elongated first insulating housing. The first housing comprises opposed sidewalls and end walls defining a cavity therebetween, and windows defined in the sidewalls. A plurality of first contacts is disposed in the cavity and each comprises a mating portion, a free end and a solder portion. The plug connector matable with the receptacle connector comprises a second insulative housing having a plug portion for insertion into the cavity of the receptacle connector, and a plurality of second contacts disposed on opposite sides of the plug portion for mating with the mating portions of corresponding first contacts. When the plug connector is mated with the receptacle connector, the free ends of the first contacts extend outward of the sidewalls through the windows, thereby preventing over insertion of the plug connector by the user into the receptacle connector.

Other objects, advantages and novel features of the invention will become more apparent from the following detailed description when taken in conjunction with the accompanying drawings.

DETAILED DESCRIPTION OF THE INVENTION

Figure 1:
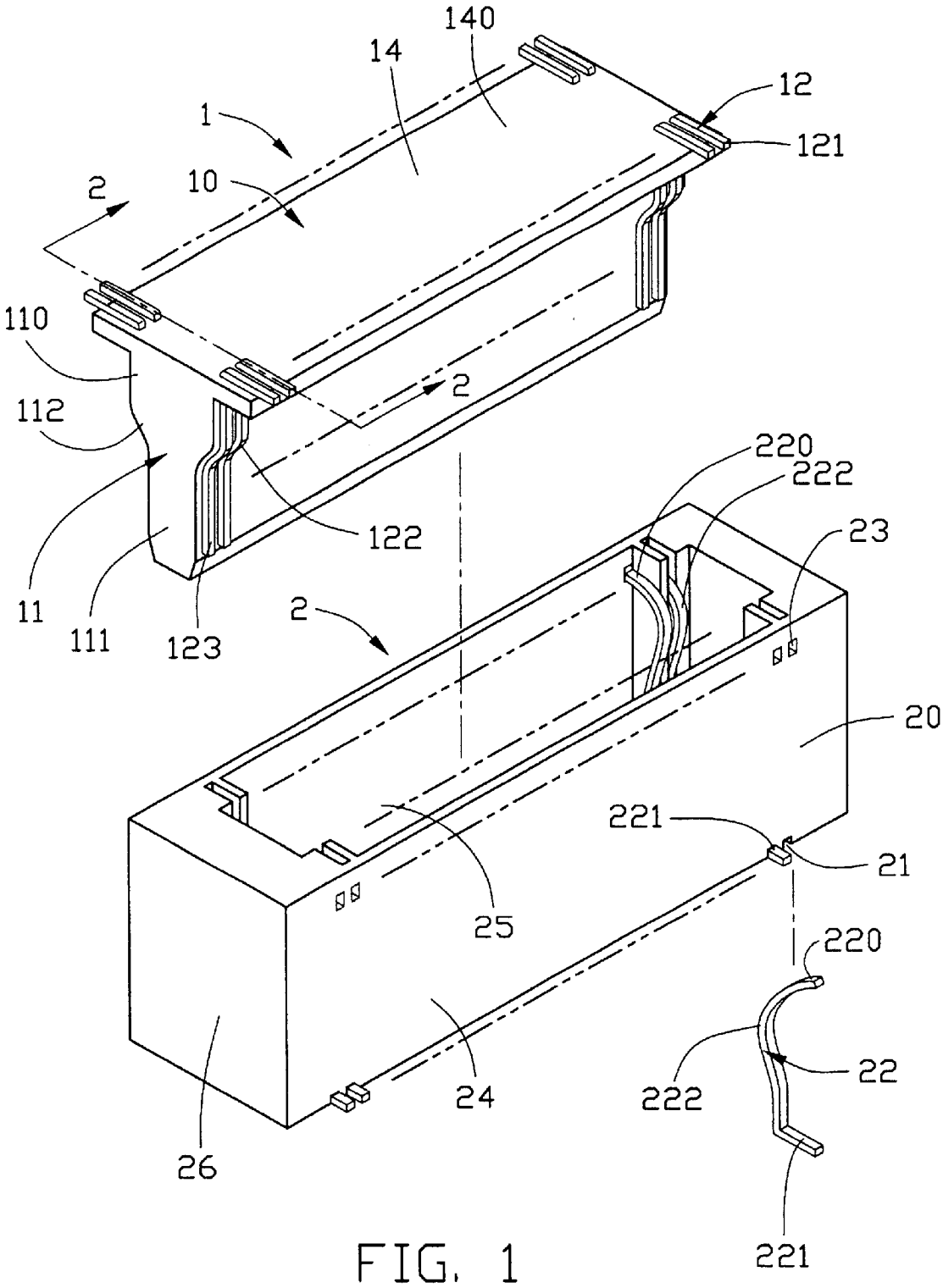
FIG. 1 is an exploded, perspective view of a board to board connector assembly in accordance with the present invention.

Reference will now be made to the drawing figures to describe the present invention in detail.

A board to board connector assembly in accordance with the present invention is shown in FIG. 1 and comprises a plug connector 1 connected with a daughter board (not shown), and a receptacle connector 2 mounted on a mother board (not shown) for mating with the plug connector 1.

The receptacle connector 2 comprises an elongated first insulating housing 20 having a pair of opposed sidewalls 24 and a pair of end walls 26 together defining a cavity 25 therebetween, and a plurality of first contacts 22. Each sidewall 24 defines a plurality of passageways 21 in the bottom, and a plurality of windows 23 in an upper portion thereof each communicating with the cavity 25 and aligned with a corresponding passageway 21. Each first contact 22 comprises a free end 220, and a solder portion 221 extending beyond an outer side of the sidewall 24 for being soldered to the mother board. The free end 220 of the first contact 22 and the corresponding window 23 are on the same level. The solder portion 221 passes through a respective passageway 21 and extends out of the first housing 20. The bending portion 222 extends upwardly from the solder portion 221 and forms an arc proximate to the free end 220. A spacing wall (not labeled) formed between every two adjacent first contacts 22 projects inwardly from inner sides of opposed sidewalls 24.

The plug connector 1 comprises a second housing 10 and a plurality of second contacts 12 received in the second housing 10. The second housing 10 has a plug portion 11 for being received in the cavity 25 of the receptacle connector 2, and a base plate 14. The plug portion 11 comprises a base portion 110, a mating end 111 and a neck portion 112 connecting the base portion 110 with the mating end 111. The width of the base portion 110 is larger than that of the mating end 111. The base plate 14 has a flat surface 140. The second contacts 12 are disposed in opposed sides of the plug portion 11. Each second contact 12 has a solder portion 121 extending transversely along the surface 140 of the base plate 14 and outward of the second housing 10 for being soldered onto the daughter board, a tail portion 123, and a bending portion 122 connecting the solder portion 121 with the tail portion 123 for mating with a mating portion 222 of a corresponding first contact 22.

Figure 2:
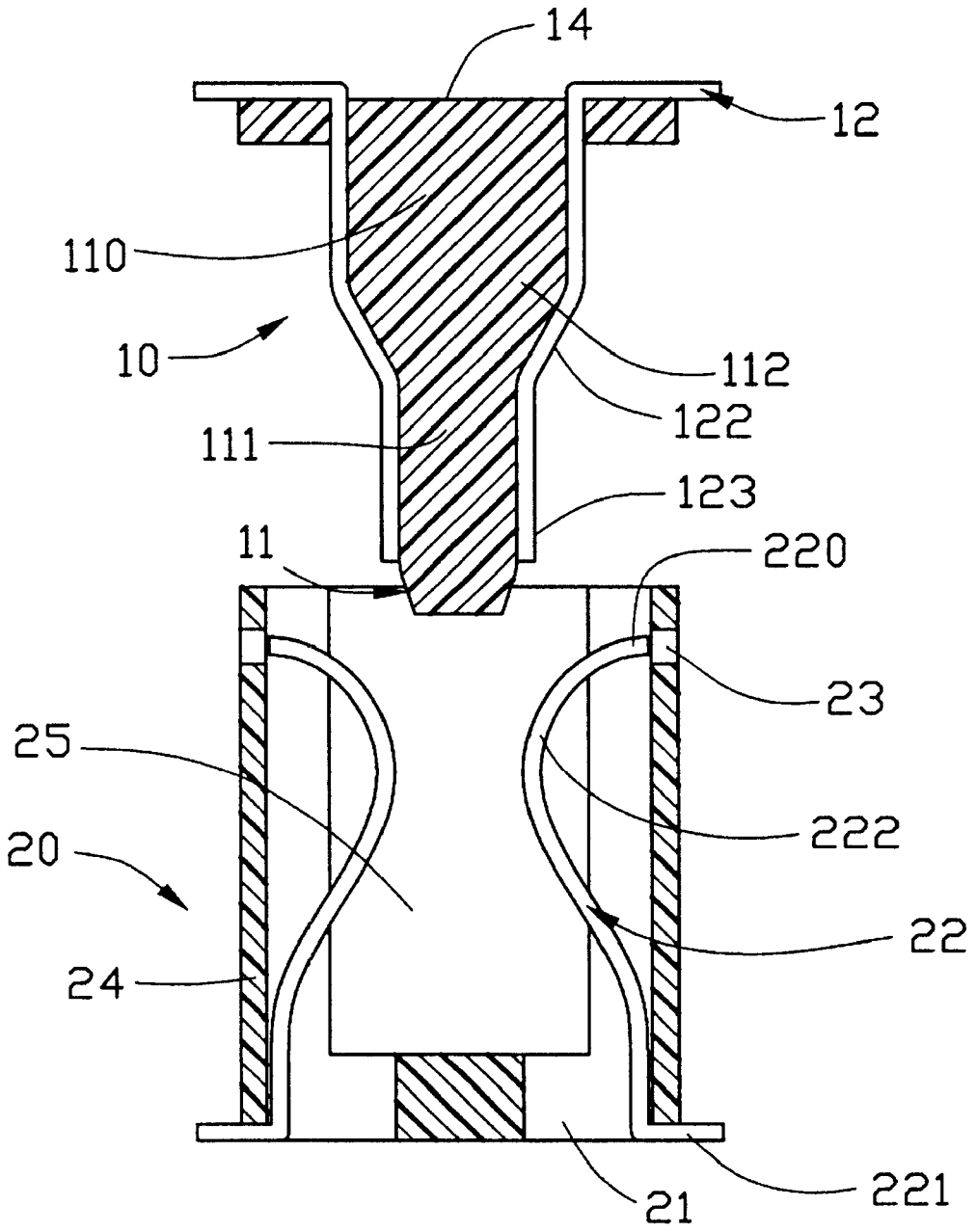
FIG. 2 is a cross-sectional view taken along line 2—2 of FIG. 1.
Figure 3:
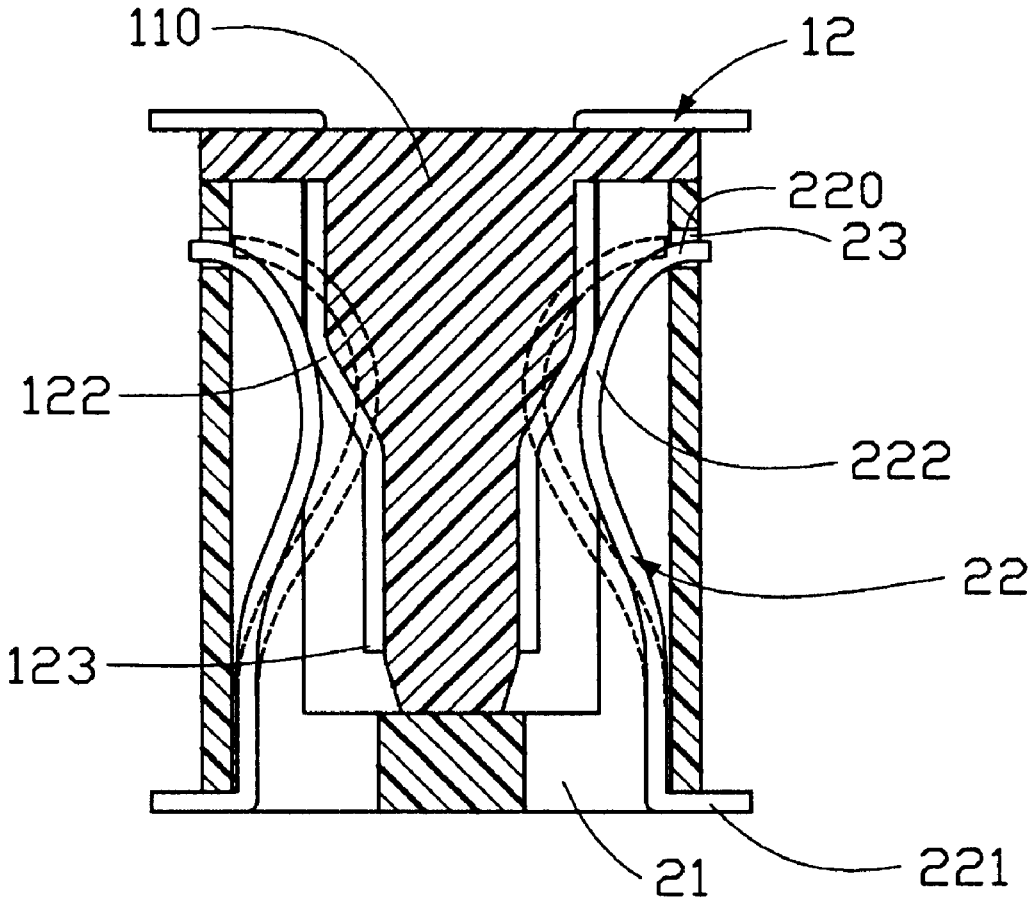
FIG. 3 is a cross-sectional view of the board to board connector assembly, illustrating the engagement between a plug connector and a receptacle connector of the board to board connector assembly.
Figure 4:
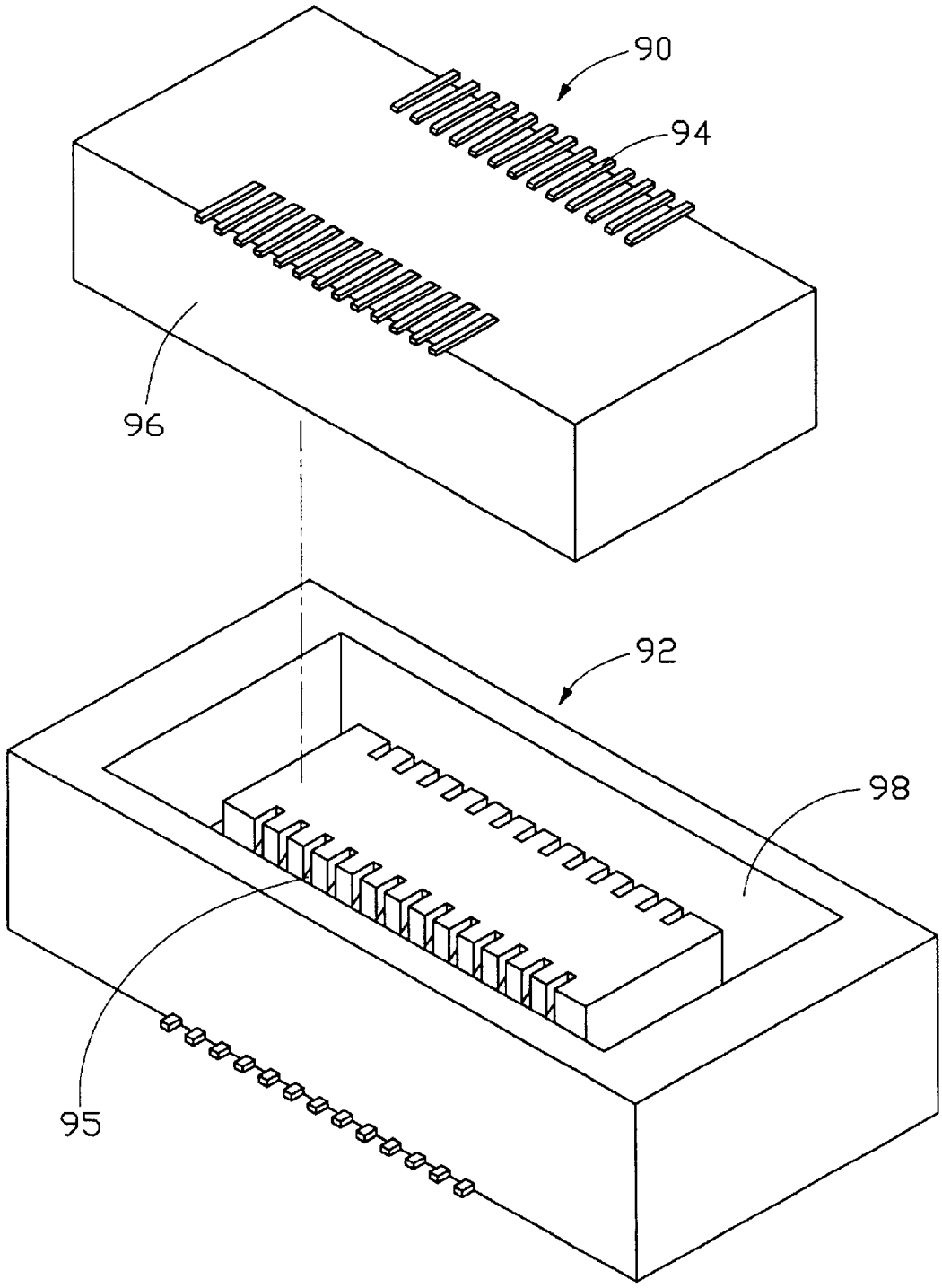
FIG. 4 (PRIOR ART)
FIG. 4 is an exploded, perspective view of a conventional board to board connector assembly.

In use, referring to FIG. 2 and FIG. 3, when the second housing 10 is inserted into the cavity 25 of the first housing 20, the second contact 12 press against and elastically deform the mating portions 222 of the first contacts 22. Accordingly, the free ends 220 of the first contacts 22 outwardly move into the corresponding windows 23. As the plug portion 11 continues inserting downward, because the width of the base portion 110 is larger than that of the mating end 111, the base portion 110 of the plug portion 11 produces a larger deformation on the first contacts 22. Therefore, the free ends 220 of the first contacts 22 pass through the windows 23 and extend out of the sidewalls 24. By such a design, the user could easily identify the full insertion of the plug connector I into the receptacle connector 2 by observing whether the free ends 220 of the first contacts 22 have extended beyond the sidewalls 24 or not. Understandably, even the free end of the first contact does not completely extend our of the sidewall and somewhat hidden within the window, the observer may still verify, to some degrees, the status of the first contact via the window.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for connecting a daughter board to a mother board, comprising:

a receptacle connector mounted on a mother board, comprising:

a first insulative housing comprising a pair of sidewalls and a pair of end walls together defining a cavity therebetween, and a plurality of windows defined in the sidewalls in communication with the cavity; and a plurality of first contacts disposed in the cavity along the sidewalls, each first contact comprising a mating portion, and a free end and a solder portion extending from opposite ends of the mating portion; and a plug connector connected with a daughter board and matable with the receptacle connector, comprising:

a second insulative housing having a plug portion for insertion into the cavity of the receptacle connector; and a plurality of second contacts being disposed on opposite sides of the plug portion for mating with the mating portions of corresponding first contacts;

wherein the free ends of the first contacts extend into corresponding windows when the plug connector is mated with the receptacle connectors wherein the free ends of the first contacts and the corresponding windows are on the same level; wherein the free ends of the first contacts are able to extend outward of the sidewalls when the plug connector is filly mated with the receptacle connector; wherein the windows are defined in upper portions of the sidewalls and the number of the windows is equal to the number of the first contacts; wherein the mating portion of the first contact extends upwardly from the solder portion and forms an arc proximate to the free end; wherein the plug portion of the second housing includes a base portion and a mating end, the width of the base portion being larger an that of the mating end.

2. An electrical connector for mating with a mating connector, comprising:

an insulative housing comprising a pair of sidewalls and a pair of end walls together defining a cavity therebetween, and a plurality of windows defined in the sidewalls in communication with the cavity; and a plurality of contacts disposed in the cavity along the sidewalls, each first contact comprising a mating portion, and a free end and a solder portion extending from opposite ends of the mating portion;

wherein the free ends of the first contacts extend into corresponding windows to allow an observer to verify displacement of the first contacts through the corresponding windows when a mating connector is mated with the electrical connector; wherein the free ends of the contacts and the corresponding windows are on the same level; wherein the free ends of the contacts are able to extend outward of the sidewalls when the mating connector is fully mated with the electrical connector; wherein the windows are defined in upper portions of the sidewalls and have a number equal to that of the contacts; wherein the mating portion of the first contact extends upwardly from the solder portion and forms an arc proximate to the free end.

3. An electrical connector assembly comprising:

a first connector including a first housing with a plurality of first contacts therein, each of said first contacts comprising a mating portion, a free end and a solder portion extending from opposite ends of the mating portion;

a second connector including a second housing with a plurality of second contacts therein; and a plurality of windows formed in a side wall of the first housing to communicate with an exterior laterally; wherein when the first and the second connectors are mated with each other, the first contacts are deformed and displaced to allow an observer to verify displacement of the first contacts through the corresponding windows; wherein the mating portion of the first contact extends upwardly from the solder portion and forms an arc proximate to the free end; wherein said free ends of the first contacts are moveable in the corresponding windows; wherein said free ends of the first contacts extend out of the side wall when the first connector and the second connector are fully mated with each other.

* * * * *